US006260501B1

(12) United States Patent
Agnew

(10) Patent No.: US 6,260,501 B1
(45) Date of Patent: Jul. 17, 2001

(54) SUBMERSIBLE APPARATUS FOR TRANSPORTING COMPRESSED GAS

(76) Inventor: Arthur Patrick Agnew, 33 Sunset Way SE, Calgary, Alberta (CA), T2X 3H6

( * ) Notice: Subject to any disclaimer, the term of this patent is extended or adjusted under 35 U.S.C. 154(b) by 0 days.

(21) Appl. No.: 09/527,586

(22) Filed: Mar. 17, 2000

(51) Int. Cl.[7] ..... B65D 88/78; B63B 25/08

(52) U.S. Cl. ..... 114/257; 114/74 R

(58) Field of Search ..... 114/256, 257, 114/74 A, 74 R, 74 T, 220, 73, 72, 321; 220/901, 581, 588

(56) References Cited

U.S. PATENT DOCUMENTS

| | | | | |
|---|---|---|---|---|
| 1,201,051 | | 10/1916 | Jack . | |
| 2,383,840 | | 8/1945 | Benckert . | |
| 3,208,449 | | 9/1965 | Bartlett, Jr. . | |
| 3,258,068 | | 6/1966 | Hollister . | |
| 3,270,905 | | 9/1966 | Kroekel . | |
| 3,435,793 | | 4/1969 | Shurtleff . | |
| 3,727,418 | * | 4/1973 | Glazier | 62/53.1 |
| 3,741,264 | | 6/1973 | Kinoshita . | |
| 3,797,445 | * | 3/1974 | Zeimer | 114/312 |
| 3,975,167 | * | 8/1976 | Nierman | 585/15 |
| 4,108,101 | * | 8/1978 | Schirtzinger | 114/245 |
| 4,307,679 | | 12/1981 | Goldsberry et al. . | |
| 4,438,719 | * | 3/1984 | Finsterwalder | 114/74 A |
| 5,235,928 | | 8/1993 | Shank, Jr. . | |
| 5,327,469 | | 7/1994 | Georgii . | |
| 5,839,383 | | 11/1998 | Stenning et al. . | |
| 6,003,460 | * | 12/1999 | Stenning et al. | 114/72 |

* cited by examiner

*Primary Examiner*—S. Joseph Morano
*Assistant Examiner*—Andy Wright
(74) *Attorney, Agent, or Firm*—I. Zborovsky

(57) ABSTRACT

A submersible apparatus for transporting compressed gas comprising a plurality of spools, each having a central bore. A long continuous length of relatively small diameter line pipe for holding compressed natural gas is wound about each spool, so that an inner end of the pipe terminates in the bore, while an outer end of the pipe terminates at outer surface of the spool. A tank has a thin housing to store the spools vertically therein, with axis of the bores horizontally to create a continuous pathway therethrough. An inner header extends through the length of the continuous pathway of the bores and has the inner ends of the pipes connected thereto. An outer header extends the length of the tank and has the outer ends of the pipes connected thereto. A pair of access ports are provided with each located at one end of the tank to provide loading/unloading nozzles and access ways for maintenance personnel.

14 Claims, 5 Drawing Sheets

SUBMERSIBLE APPARATUS FOR TRANSPORTING COMPRESSED GAS

BACKGROUND OF THE INVENTION

1. Field of the Invention

The present invention relates generally to storage and transporting facilities. More particularly, the invention comprises a submersible apparatus for transporting compressed gas that provides a way of transporting natural gas in a high pressure state. Compressed natural gas is stored within long sections of pipe coiled on spools within a tank. The axis of each spool is configured horizontally and interconnected with numerous additional spools to produce a cylindrical pressure containing transportation device.

In general, a first field of use of the disclosed invention is by ship cargo transporting companies as the most likely benefactors of the unique advantages of the instant invention. However, many other fields, such as truck, air freight and railroad companies, could find potentially beneficial uses of this invention.

Thus, it can be seen that the potential fields of use for this invention are myriad and the particular preferred embodiments described herein is in no way meant to limit the use of the invention to the particular field chosen for exposition of the details of the invention.

A comprehensive listing of all the possible fields to which this invention may be applied is limited only by the imagination and is, therefore, not provided herein. Some of the more obvious applications are mentioned in the interest of providing a full and complete disclosure of the unique properties of this previously unknown general purpose article of manufacture. It is to be understood from the outset that the scope of this invention is not limited to these fields or to the specific examples of potential uses presented herein.

2. Description of the Prior Art

Natural gas is currently transported long distances as liquefied natural gas across the ocean. Gas is also transported along offshore pipelines, however, there exist limits on the distance pipelines are practical. The capital costs make the liquefied natural gas system impractical for many of the worlds gas fields. The green house gas emissions associated with the liquefied natural gas process make the liquefied natural gas less appealing environmentally. Transporting natural gas at high pressure and ambient temperature (compressed natural gas), on a ship based or barge based system is practical and most likely to find application in the short to medium distance shuttle application.

The challenge with a ship based compressed natural gas design will be capital cost and safety concerns associated with fire and explosions. The capital cost of a ship-based system is approximately fifty percent compressed natural gas containers and fifty percent ship. In other words, the ship doubles the cost of the compressed natural gas system. Concerns with respect to fire and explosions can greatly be mitigated with proper designs, elimination of explosive environment, and over pressure protection etc. The risk to ship personnel from a catastrophic event can never be totally eliminated.

Attempts have been made in the prior art to devise storage and transporting facilities. Several different prior patents are discussed having U.S. Pat. No. 1,201,051, issued to Jack on Oct. 10, 1916; U.S. Pat. No. 2,383,840, issued to Benckert on Aug. 28, 1945; U.S. Pat. No. 3,208,449, issued to Bartlett, Jr. on Sep. 28, 1965; U.S. Pat. No. 3,258,068 issued to Hollister on Jun. 28, 1966; U.S. Pat. No. 3,270,905, issued to Kroekel on Sep. 6, 1966; U.S. Pat. No. 3,435,793, issued to Shurtleff on Apr. 1, 1969; U.S. Pat. No. 3,741,264, issued to Kinoshita on Jun. 26, 1973; U.S. Pat. No. 4,307,679, issued to Goldsberry et al. On Dec. 29, 1981; U.S. Pat. No. 5,235,928, issued to Shank, Jr. on Aug. 17, 1993; U.S. Pat. No. 5,327,469, issued to Georgii on Jul. 5, 1994; and U.S. Pat. No. 5,839,383, issued to Stenning et al. On Nov. 24, 1998.

U.S. Pat. No. 1,201,051 to Jack discloses a submersible storage tank. The tank for the storage of oil, is adapted to be floated or submerged at will. The tank when submerged is under a balanced pressure both within and without.

U.S. Pat. No. 2,383,840 to Benckert discloses and under water fuel storage system. It is a fuel supply system which can be located underwater and easily concealed from observation from land or air.

U.S. Pat. No. 3,208,449 to Bartlett, Jr. discloses a compact walk-around rebreathing device. It is a respiratory apparatus being a compact self-contained breathing device having an air regeneration feature for minimizing the amount of oxygen supplied from an external storage element, as well as being useful in any contaminated atmosphere.

U.S. Pat. No. 3,258,068 to Hollister discloses a shell and tube heat exchanger. It is an apparatus by which a heat exchanger of the shell and tube type can be constructed taking advantage of the hemispherical shape design and strength offered thereby.

U.S. Pat No. 3,270,905 to Kroekel discloses a pressure container. It is a novel light weight sheet metal pressure container especially useful for the storage and transmission of fluids at pressure of several thousands of pounds per square inch.

U.S. Pat. No. 3,435,793 to Shurtleff discloses portable submarine tanks. Each tank maybe used for both storage and transportation, being formed of a flexible material, such that it may be collapsed and transported even by air to a selected location.

U.S. Pat. No. 3,741,264 to Kinoshita discloses a floating structure for unloading liquid cargo. It is equipped in its inside with a pump to allow unloading of cargo oil from a tanker even if no cargo oil pump is provided in the ship.

U.S. Pat. No. 4,307,679 to Goldsberry et al. discloses a submergible barge retrievable storage and permanent disposal system for radioactive waste. It involves placing the radioactive waste within a package, placing the package in a storage tube, sealing and cooling the tube within a barge, and subsequently floating the barge to a disposal site where it is submerged to the bottom surface.

U.S. Pat. No. 5,235,928 to Shank, Jr. discloses a towed submergible, collapsible, steerable tank. It is a towed fuel tank that is submergible, collapsible and steerable, so as to extend a ship's range.

U.S. Pat. No. 5,327,469 to Georgii discloses an arrangement for the storage of environmentally hazardous waste. The inventive offshore storage facility enables any leakages that may occur to be monitored and remedied much more easily than is the case with known facilities.

U.S. Pat. No. 5,839,383 to Stenning et al. discloses a ship based gas transport system. It is a gas storage system, particularly adapted for transportation of large quantities of compressed gas on board ship. It includes a large storage volume provided by coils of substantially continuous pipe.

The present invention is completely different than all of these prior art patents in that it consists of an apparatus for transporting natural gas on a high pressure state or compressed natural gas within long sections of pipe coiled on spools within a tank. The axis of each spool is configured horizontally and interconnected with numerous additional spools to produce a cylindrical pressure containing transportation device.

None of the above inventions and patents, taken either singly or in combination, is seen to describe the instant invention as claimed.

SUMMARY OF THE INVENTION

The present invention is a submersible apparatus for transporting compressed gas that consists of a compressed natural gas tank having a series of spools configured horizontally along their axis to create a long cylindrical shape. On each spool is wound a long continuous length of relatively small diameter line pipe. One end of the pipe terminates in the bore of the spool and one end terminates at outer surface of the spool. With the spools connected the bores create a continuous pathway to house isolation valves and an inner header. An outer header can be connected along the top of the spools. These headers can be connected at either end of the tank and further connected to loading/unloading nozzles. The cylindrical tank is sheathed by a smooth hydrodynamic shape. The compressed natural gas tank may be designed to be neutrally buoyant, therefore, allowing easy surface and sub-surface operating. Individual or multiple tanks will be towed by a specially designed towing ship.

Accordingly, it is a principal object of the invention to provide a submersible apparatus for transporting compressed gas that will overcome the shortcomings of the prior art devices.

Another object of the invention is to provide a submersible apparatus for transporting compressed gas that is a compressed natural gas hauling device which has axially aligned groups of spools in a tank, with each spool having long continuous length of relatively small diameter line pipe to hold the compressed natural gas therein, so that the housing of the tank can be thin.

An additional object of the invention is to provide a submersible apparatus for transporting compressed gas that is inherently safe from fire and explosion.

A further object of the invention is to provide a submersible apparatus for transporting compressed gas that is simple and easy to use.

A still further object of the invention is to provide a submersible apparatus for transporting compressed gas that is economical to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
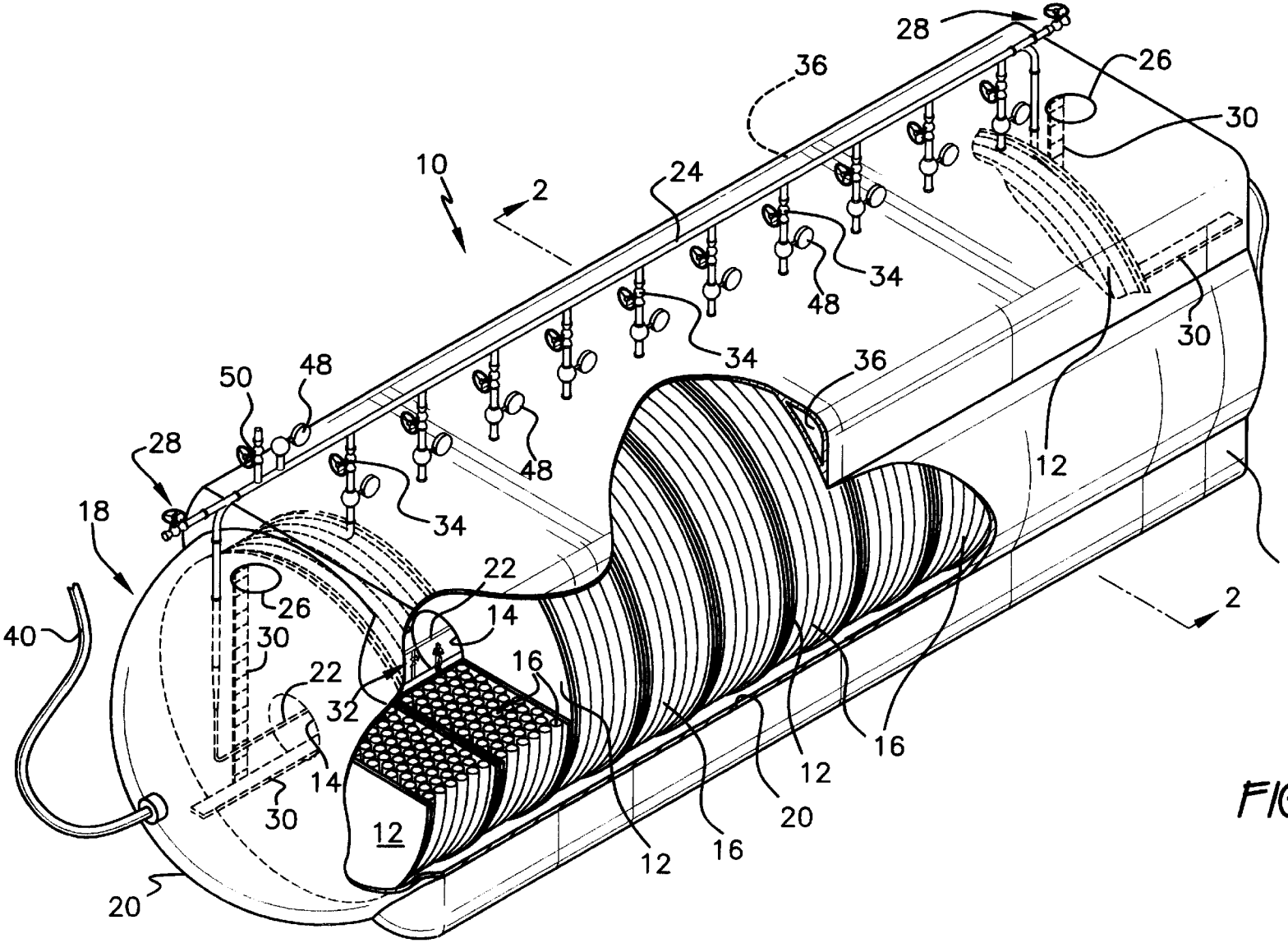
FIG. 1 is a cutaway perspective, partial cross sectional view of one tank of the present invention.

Turning now descriptively to the drawings, in which similar reference characters denote similar elements throughout the several views, FIGS. 1 through 6 illustrate the various components of the present invention being a submersible apparatus 10 for transporting compressed gas comprising a plurality of spools 12, each having a central bore 14. A long continuous length of relatively small diameter line pipe 16 for holding compressed natural gas is wound about each spool 12, so that an inner end of pipe 16 terminates in bore 14, while an outer end of pipe 16 terminates at outer surface of spool 12. A tank 18 has a thin housing 20 to store spools 12 vertically therein, with axis of bores 14 horizontally to create a continuous pathway therethrough. An inner header 22 extends through the length of continuous pathway of bores 14 and has inner ends of pipes 16 connected thereto. An outer header 24 extends the length of tank 18 and has outer ends of pipes 16 connected thereto. A pair of access ports 26 are provided with each located at one end of tank 18 to provide loading/unloading nozzles 28 and access ways 30 for maintenance personnel.

A first set of isolation valves 32 are located between inner ends of pipes 16 and inner header 22. A second set of isolation valves 34 are located between outer ends of pipes 16 and outer header 24, should one of the spools 12 be required to be isolated from other spools 12. Thin housing 20 of tank 18 is generally cylindrical and includes ballasting compartments 36, so that tank 18 can surface a body of water 38 for loading and unloading, while tank 18 can be submersed to a neutral buoyant condition well below wave affect while en route in open seas. A tow cable 40 is connected at one end to a front end of tank 18 and at another end to specially fitted tug boat 42 with monitoring and controls equipment onboard. Control and communication cables 44 are carried with tow cable 40. A gas fuel line 46 is also carried with tow cable 40.

Figure 6:
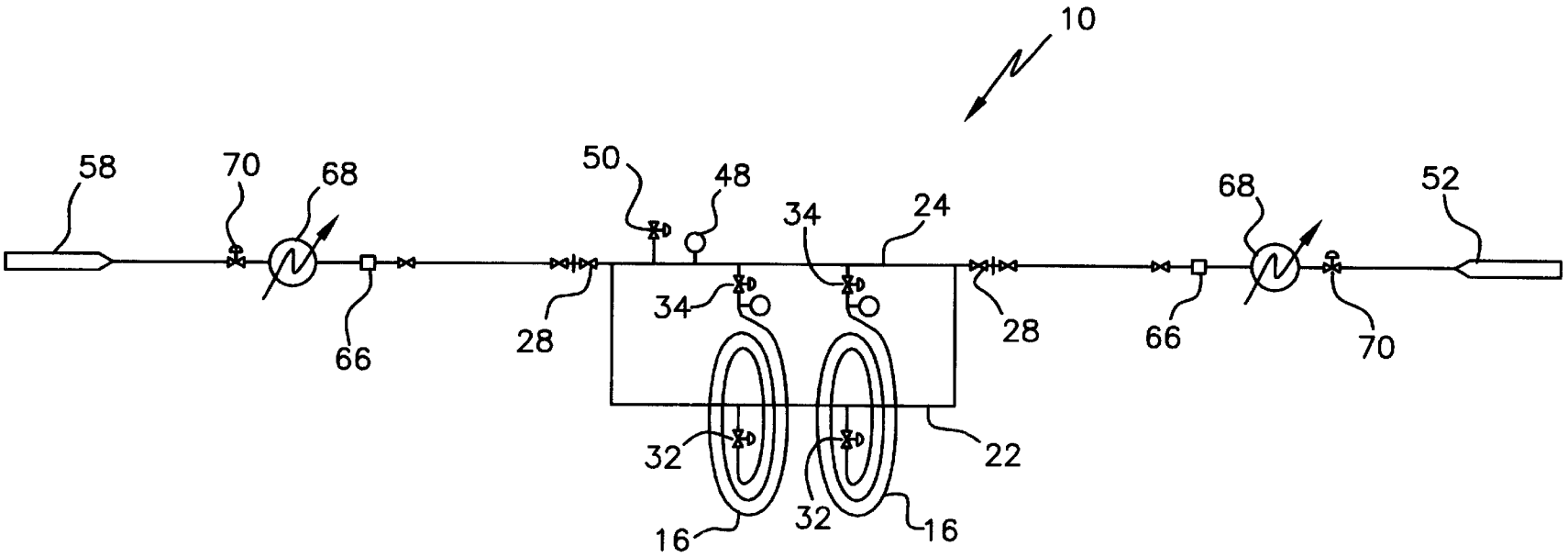
FIG. 6 is a process flow data diagram on board one tank.

As best seen in FIG. 6, a pressure gauge 48 is connected to outer header 24. A vent valve 50 is connected to outer header 24. When a high-pressure situation is caused by thermal expansion it can be monitored by a controller person who may elect to vent some natural gas by opening vent valve 50. When a low-pressure situation arises such as a leak in one pipe 16, the controller person will respond by closing respective isolation valves 32, 34 and monitor pressure, until one pipe 16 which is leaking is found so that the balance of the payload is preserved.

Figure 5:
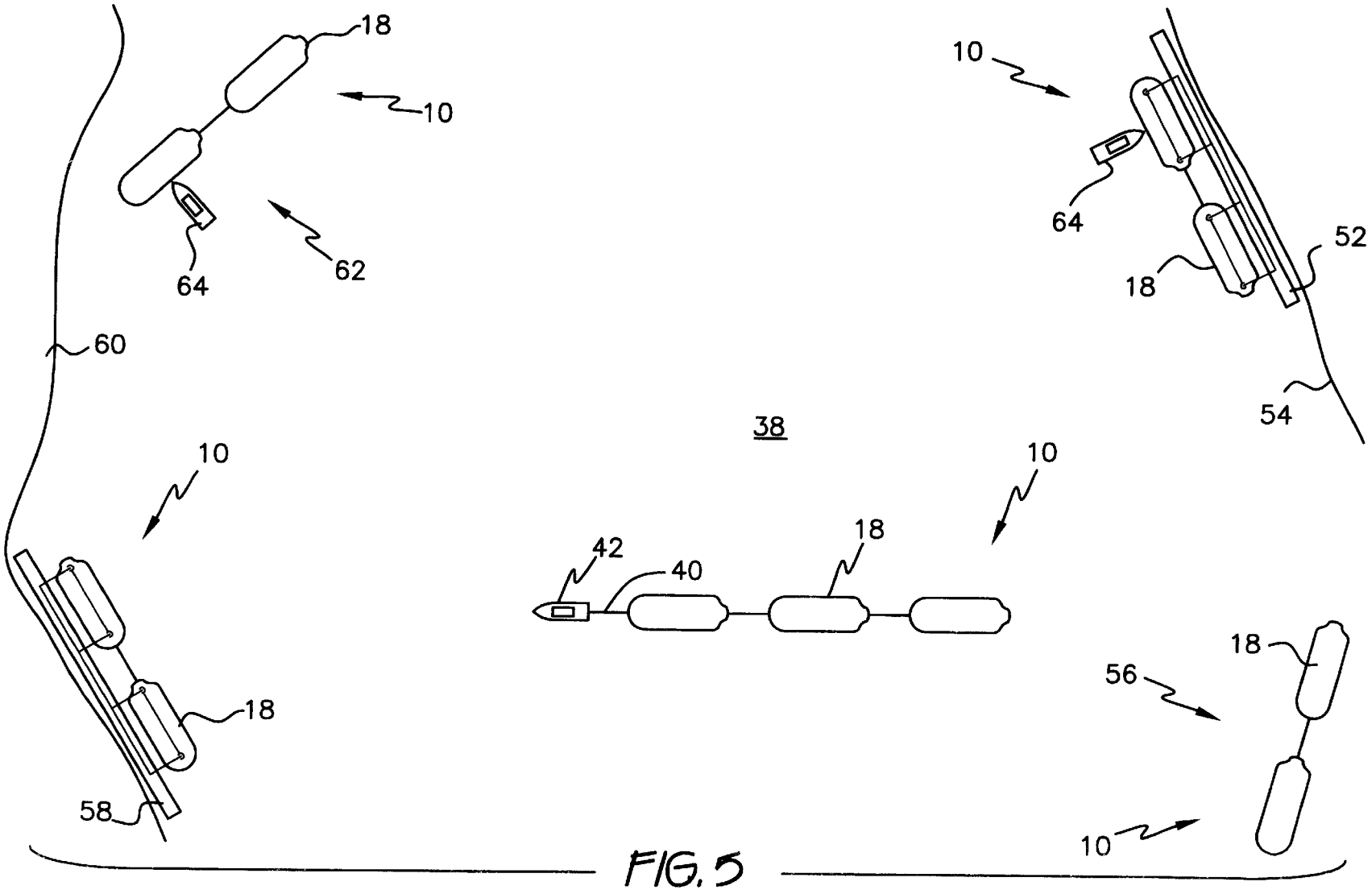
FIG. 5 is a plan view of a shipping, loading and unloading configuration of the present invention.

As shown in FIG. 5, a loading pier 52 is between a first piece of land 54 and a first staging area 56 in the body of water 38. An unloading pier 58 is between a second piece of land 60 and a second staging area 62 in the body of water 38. Harbor tugs 64 can position a plurality of interconnecting tanks 18 at loading pier 52, first staging area 56, unloading pier 58 and second staging area 62 in the body of water 38. Loading pier 52 and unloading pier 58 further include metering equipment 66 connected to loading/unloading nozzles 28. Heating equipment 68 is connected to metering equipment 66, and pressure controlling equipment 70 is connected to the heating equipment 68.

Shipping tanks 18 are designed for payloads of 500 to 1,000 MMSCF of natural gas per tank and may be towed individually or in multiples. Tank 18 is 100 to 130 m long and 30 to 40 m in width. Each spool 12 is 30 to 40 m in diameter with a 3 m-diameter bore 14. Each spool 12 weighs 5,000 to 7,000 tons with pipe 16 included and is structurally designed for handling craning spools 12. Pipe 16 is 6" to 10" nominal pipe constructed to ASME A106 or AP15L specification and the highest-grade material feasible. External voids will be filled with a non-corrosive fluid to eliminate external corrosion. Inner end of pipe 16 is connected to inner header 22 which runs the length of bore 14 and joins to outer header 24 at loading/unloading connection area. Outer header 24 runs along tank 18 connecting to outer ends of pipe 16. Isolation valves 32,34 are located at either ends of pipe 16, should a spool 12 be required to be isolated from other spools 12. Ten to fifteen spools 12 make up overall tank 18. Access ports 26 are included at either end of pipe 16 to allow for periodic internal pipeline inspection.

Outside of tank 18 is fitted with a thin housing 20 formed into a smooth hydrodynamic shape. All spaces between this housing 20 and pipes 16 is filled with an incompressible non-corrosive fluid. This fluid will be in hydraulic communication with the body of water 38 and, therefore, housing 20 will not have to support a pressure differential, thus, greatly reducing the structural requirement of housing 20. Completed tank 18 is designed to be very close to neutrally buoyant when fully submerged in water. A relatively small amount of ballasting capability is provided to allow the operator to bring tank 18 to the surface at loading and unloading ports, and keep tank 18 fully submerged and well below wave effect while en route in open seas.

Structural strength of tank 18 is provided by interconnected spools 12. Access ports 26 at either end of tank 18 provide loading/unloading nozzles 28 and access ways 30 for maintenance personnel. Tank 18 is normally towed by a specially fitted tug boat 42 with monitoring and controls equipment onboard. Tow cable 40 is accompanied by control and communication cables 44. To provide greater economic advantage, tug boat 42 is powered by natural gas burning turbine engines. Gas fuel line 46 also accompanies tow cable 40. The design pressure of pipes 16 is 1,800 to 2,000 PSIG to take advantage of best compressibility at ambient ocean temperatures. Apparatus 10 generally takes on the design and operating philosophies of a pipeline system with the exception of the outer layer of the pipe coils. The inner layers of the coil are designed to the usual design factor of 0.72 of most pipeline codes, however, this should be increased to 0.5 for the outer layer to account for axial stresses. The operating temperature varies little from the ocean temperature.

Figure 3:
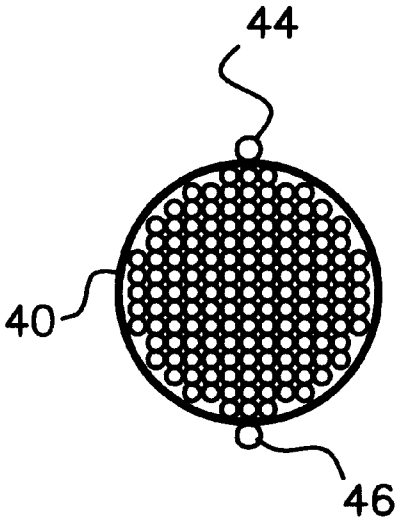
FIG. 3 is an enlarged cross sectional view taken along line 3—3 in FIG. 4 showing the tow cable assembly in greater detail.
Figure 2:
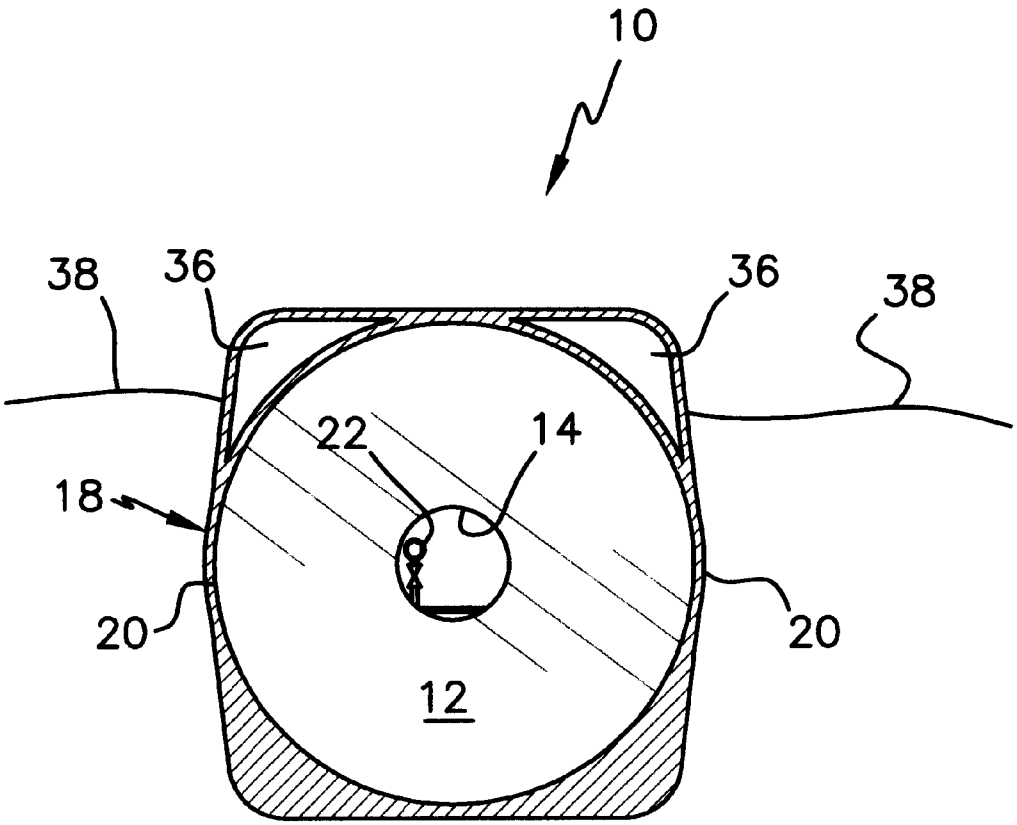
FIG. 2 is a diagrammatic cross sectional view taken along line 2—2 in FIG. 1.
Figure 4:
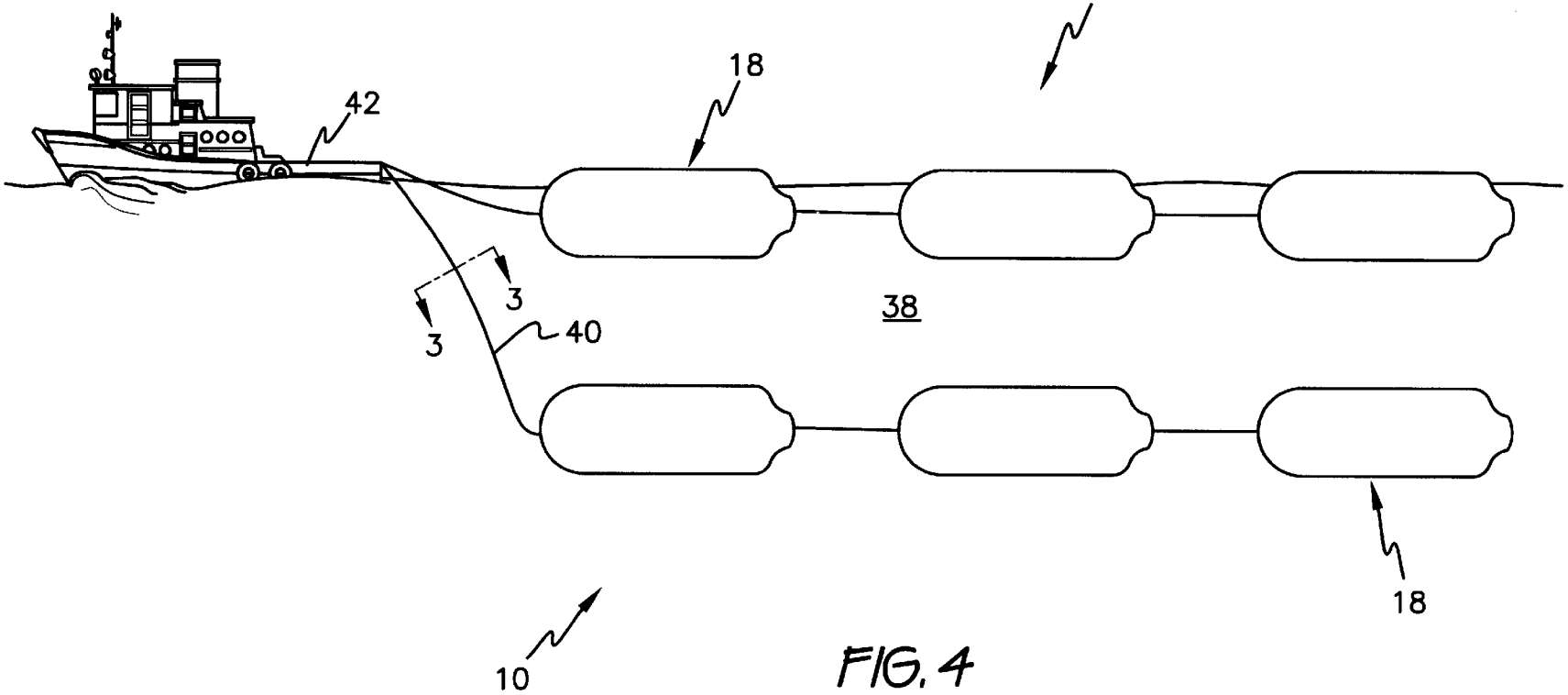
FIG. 4 is a side view showing a towing configuration in harbor and in transit positions.

While in transit the entire apparatus 10 is monitored from a control room located on ocean tug 42. A high-pressure situation caused by thermal expansion is monitored by the controller person who may elect to vent some natural gas by opening vent valve 50. This situation is unlikely, in that tank 18 is being depleted while in transit. A low-pressure concern noticed by the controller person can indicate concerns about a leak in one of the spools 12. A response is to isolate each spool 12 by closing isolation valves 32, 34 and monitoring pressure in each segment to determine which segment is leaking, so that the balance of the payload may be preserved by maintaining isolation of the depressured segment. The onshore facilities at the loading and unloading piers 52, 58 will include pressure controlling equipment 70, heating equipment 68 to eliminate hydrate concerns and metering equipment 66. A large compressed natural gas system is depicted in FIG. 3. This operation consists of a loading pier 52, unloading pier 58, and staging areas 56, 58 for assembling multi-tank tows, as well as harbor coordination systems with small harbor tugs 64.

It is to be understood that the present invention is not limited to the embodiments described above, but encompasses any and all embodiments within the scope of the following claims.

I claim:

1. A submersible apparatus for transporting compressed gas comprising:

a plurality of spools, each defining a spool central axis therethrough and an outer periphery therearound, said spools interconnected to each other so that said central axes of said spools are substantially coaxially aligned and so that said spools together form a self supporting unitary assembly whereby forces exerted on said assembly parallel to and normal to said aligned central axes are distributed throughout said assembly of said spools;

a plurality of pieces of relatively small diameter pipe for holding compressed natural gas, each piece of pipe wound around one of said spools; and, an elongate tank supported on said assembly of said spools, said tank including a thin tubular housing having opposed ends and extending around said interconnected spools, said tubular housing closed at both ends and conforming in shape to said outer peripheries of said spools so that said housing is supported by said interconnected spools, said housing having a smooth hydrodynamic shape and configured so as to maintain the central axes of said spools generally horizontal in the water.

2. The submersible apparatus for transporting compressed gas as recited in claim 1 adapted to be towed by a tug boat equipped with monitoring and control equipment and powered by compressed gas, said submersible apparatus further including:

tow cable means for connecting one end of said submersible apparatus to said tug boat;

control and communication cable means for connecting said submersible apparatus with said tug boat; and a gas fuel line for connecting at least one of said small diameter pipes to said tug boat so that compressed gas stored in said submersible apparatus is supplied to said tug boat.

3. The submersible apparatus of claim 1 further including buoyancy regulating means for selectively changing the buoyancy of said apparatus so that said apparatus remains substantially submerged in the water to minimize the temperature changes to which the compressed gas within said pipes is subjected thereby allowing pipe sizing to meet lesser pressure pipe design codes.

4. The submersible apparatus for transporting compressed gas as recited in claim 3, wherein said thin housing of said tank is generally cylindrical; and wherein said bouyancy regulating means further includes ballasting compartments that can be selectively filled and emptied with a ballasting fluid so that said submersible apparatus can selectively surface a body of water for loading and unloading and be submersed to a neutral buoyant condition well below any wave affect while en route in open seas.

5. The submersible apparatus of claim 1 wherein said spools are interconnected so that towing forces are imposed on said assembly of spools.

6. The submersible apparatus of claim 1 wherein said spools are interconnected so that, when one of said apparatus is towing another of said apparatus, the towing forces exerted on said first mentioned apparatus by said second mentioned apparatus are transmitted through said spools in said assembly on said first mentioned apparatus.

7. The submersible apparatus of claim 1 further comprising:

an incompressible fluid filling the space between said spools and pipes and said tank, said fluid in hydraulic communication with the water in which said apparatus is submerged so that the pressure differential across said housing is substantially zero.

8. The submersible apparatus of claim 1 wherein each of said spools defines a bore therethrough concentrically of said central axis, said bores of said spools being substantially aligned to define a common continuous passageway through said assembly of said spools; and further comprising at least one sealable access opening in said tank communicating with said common passageway through said spools so that access is provided for personnel to said passageway through said spools.

9. The submersible apparatus of claim 1 wherein said pieces of pipe are wound around said spools so as to form continuous lengths of small diameter pipe around each of said spools having opposed ends; and further including header means operatively connecting said lengths of said pipe in parallel to each other whereby compressed gas can be supplied to and removed from said lengths of pipe on said spools via said header means.

10. The submersible apparatus for transporting compressed gas as recited in claim 9, further including:

pressure gauge means operatively connected to said header means so as to indicate the pressure within said header means; and venting valve means operatively connected to said header means, so that when a high-pressure occurs within said header means, said venting valve means can be operated to vent some of the compressed gas.

11. The submersible apparatus of claim 9 wherein said header means further includes:

first header means operatively connecting one of said ends of said lengths of pipe on each of said spools in parallel with one of said ends of said lengths of pipe on each of said other spools; and second header means operatively connecting the other of said opposed ends on each said length of pipe on each of said spools so that said lengths of pipe are connected in parallel.

12. The submersible apparatus for transporting compressed gas as recited in claim 11, further including:

a first set of isolation valves operatively connecting said lengths of said pipes to said first header; and a second set of isolation valves operatively connecting said lengths of said pipes to said second header for selectively isolating said length of said pipe on each of said spools from said lengths of said pipes on the other of said spools.

13. The submersible apparatus of claim 1 wherein said pieces of pipe are wound around said spools in concentric layers, the outer layer of said pieces of pipe having a design factor of about 0.5 and the remaining inner layers of said pieces of pipe having a design factor of about 0.72 so that said outer layer helps absorb the axial stresses to which said submersible apparatus is subjected.

14. The submersible apparatus of claim 1 wherein said pieces of pipe have a design pressure of at least 1,800 PSIG.

* * * * *